United States Patent [19]

Ohsugi et al.

[11] Patent Number: 4,758,326

[45] Date of Patent: Jul. 19, 1988

[54] METHOD OF PRODUCING PRECURSOR PITCHES FOR CARBON FIBERS

[75] Inventors: Yukihiro Ohsugi; Kozo Yudate; Mamoru Kamishita, all of Chiba, Japan

[73] Assignees: Kawasaki Steel Corporation, Kobe; Nitto Boseki Co., Ltd., Fukushima, both of Japan

[21] Appl. No.: 930,045

[22] Filed: Nov. 12, 1986

Related U.S. Application Data

[63] Continuation of Ser. No. 781,979, Sep. 30, 1985, abandoned.

[30] Foreign Application Priority Data

Oct. 5, 1984 [JP] Japan ..... 59-209532

[51] Int. Cl.[4] ..... C10C 1/20; C10C 3/02

[52] U.S. Cl. ..... 208/45; 208/39; 208/22; 423/447.6

[58] Field of Search ..... 208/45, 39

[56] References Cited

U.S. PATENT DOCUMENTS

| | | | |
|---|---|---|---|
| 2,631,982 | 3/1953 | Donegan | 208/39 |
| 3,147,205 | 9/1964 | Ohsol | 208/45 |
| 3,692,663 | 9/1972 | Ueda et al. | 208/44 |
| 3,761,387 | 9/1973 | Wegner | 208/45 |
| 3,992,281 | 11/1976 | Benade | 208/39 |
| 4,127,472 | 11/1978 | Migitaka et al. | 208/45 |
| 4,184,942 | 1/1980 | Angler | 208/44 |
| 4,267,061 | 5/1981 | Semo | 208/39 |
| 4,277,324 | 7/1981 | Greenwood | 208/45 |
| 4,283,269 | 8/1981 | Greenwood | 208/45 |
| 4,369,171 | 1/1983 | Grindstaff et al. | 208/45 |
| 4,402,928 | 9/1983 | Lewis et al. | 423/447.1 |
| 4,405,439 | 9/1983 | Simone | 208/45 |
| 4,443,324 | 4/1984 | Diefendorf et al. | 208/39 |
| 4,482,452 | 11/1984 | Shigeta et al. | 208/39 |
| 4,502,943 | 3/1985 | Dickakian | 208/45 |
| 4,503,026 | 3/1985 | Dickakian | 208/45 |
| 4,517,072 | 5/1985 | Cukier et al. | 208/45 |
| 4,575,412 | 3/1986 | Yudate et al. | 208/45 |
| 4,620,919 | 11/1986 | Uemura et al. | 208/39 |
| 4,640,761 | 2/1987 | Mori et al. | 208/44 |

FOREIGN PATENT DOCUMENTS

| | | | |
|---|---|---|---|
| 116792 | 9/1980 | Japan | 208/45 |
| 181612 | 5/1965 | U.S.S.R. | 208/39 |
| 342886 | 6/1970 | U.S.S.R. | 208/45 |
| 595358 | 3/1978 | U.S.S.R. | 208/42 |

*Primary Examiner*—H. M. S. Sneed
*Assistant Examiner*—Helane Myers
*Attorney, Agent, or Firm*—Balogh, Osann, Kramer, Dvorak, Genova & Traub

[57] ABSTRACT

A method of producing a precursor pitch suitable for the production of carbon fibers, which method includes dissolving a coal tar pitch in a particular solvent to remove a solvent insoluble matter, distilling off the solvent to obtain a purified pitch containing no free carbon, and heat-treating the purified pitch to obtain an objective precursor pitch.

6 Claims, No Drawings

METHOD OF PRODUCING PRECURSOR PITCHES FOR CARBON FIBERS

This application is a continuation of application Ser. No. 781,979, filed Sept. 30, 1985 abandoned.

BACKGROUND OF THE INVENTION

1. Field of the Invention

This invention relates to a novel method of producing a precursor pitch as a starting material for the production of carbon fibers.

2. Related Art Statement

The production of carbon fibers is roughly classified into a method of firing synthetic fiber such as polyacrylonitrile fiber or the like and a method of spinning a tar pitch as a starting material and carbonizing the resulting fiber. Among them, the former method has drawbacks that the cost of the starting material is high and the carbonization yield is low. On the other hand, in the latter method, there is no problem on the cost and carbonization yield, but it is necessary to prepare a precursor pitch for the production of carbon fibers from the starting pitch. In the preparation of such a precursor pitch, it is required to remove insoluble solid matter from the starting pitch. Further, since mesophase spherules (adversely affecting the spinnability and the strength of carbon fiber) are produced during the heating, if it is intended to prevent the occurrence of mesophase spherule, the low molecular weight component can not be removed sufficiently and consequently the infusibility is unfavorably degraded. In order to improve the infusibility, there has been proposed a method of hydrogenating the starting pitch with a hydrogen gas under a high pressure or with a specific hydrogen donor solvent in Japanese Patent Application Publication No. 45-28018, but this method is not yet suitable for an industrially practical use.

Furthermore, a method of removing a solvent insoluble matter from coal tar or the like has been proposed in Japanese Patent Application Publication No. 49-26481 and Japanese Patent laid open No. 52-28501. In this case, quinoline insoluble matter contained in the starting coal tar (adversely affecting the quality of objective needle pitch coke) is extracted and separated with a petroleum solvent, e.g. an aliphatic solvent, which is entirely different from the object of the invention as mentioned below.

In Japanese Patent laid open No. 57-159885, there is disclosed a method wherein a heavy coal oil is added with a ketone solvent to remove insoluble matter and then the resulting pitch is subjected to a heat treatment. In this case, the particular ketone solvent must be used, and further a nitration solvent must be added in the heat treatment.

In Japanese Patent Application Publication No. 55-144087, there is disclosed a method of extracting a substance having particular properties with a solvent from soluble matter obtained after the removal of quinoline insoluble matter from the pitch. In this case, however, the yield is low and the production step is complicated. Further, the substance having particular properties is a starting material for optically antisotropic pitch, which is essentially different from optically isotropic pitch aimed at by the present invention.

SUMMARY OF THE INVENTION

It is an object of the invention to solve the aforementioned problems of the prior art and to provide a method of producing a precursor pitch for the production of carbon fibers having improved heat stability, spinnability and infusibility without performing a specific treatment such as hydrogenation treatment or the like.

The inventors have made various studies in order to achieve the above object and found that the precursor pitch for the production of carbon fibers having improved heat stability, spinnability and infusibility is produced with hardly producing mesophase without using the specific treatment such as hydrogenation or the like and the specific solvent or additive by subjecting a pitch after the removal of pyridine insoluble matter from a tar pitch to a heat treatment, and as a result the present invention has been accomplished.

According to the invention, there is the provision of a method of producing a precursor pitch for the production of carbon fibers, which comprises dissolving a coal tar pitch in an aromatic, low-boiling solvent to remove a solvent insoluble matter therefrom, distilling off the solvent from the resulting solution to obtain a purified pitch containing no free carbon, and then subjecting the purified pitch to a heat treatment for thermal reforming of the pitch, so as to obtain an optically isotropic precursor pitch.

DETAILED DESCRIPTION OF THE INVENTION

In the method according to the invention, the coal tar pitch is dissolved in a proper aromatic, low-boiling solvent having a boiling point of not more than 250° C. such as pyridine, gas light oil, tar light oil or the like, from which quinoline and pyridine insoluble matters are separated and removed by a proper separating means, such as centrifugal separation, stationary separation, filtration or the like. Thereafter, the solvent is distilled off from the resulting solution to obtain a purified pitch containing no free carbon and a little high molecular weight component. Then, the purified pitch is subjected to a heat treatment, whereby a precursor pitch for the production of carbon fibers having improved properties can be produced.

According to the invention, it is necessary to reduce the pyridine insoluble matter in the starting pitch to not more than 5% by weight, preferably not more than 1.5% by weight and the quinoline insoluble matter to a trace amount by the above separating means. Because, mesophase is not formed or hardly formed in the subsequent heat treament for producing a precursor pitch having an improved heat stability without the specific treatment such as hydrogenation or the like.

As the aromatic, low-boiling solvent, use may be made of any solvents having a boiling point of not more than 250° C., which includes benzene, toluene, xylene, pyridine, raw naphthalene oil, gas light oil, tar light oil and a mixture thereof. The reason why the boiling point of the solvent is limited to not more than 250° C. is based on the facts that such a solvent is easy to be recovered from the solution after the removal of the insoluble matter and that high molecular weight components corresponding to high heat-reactive pyridine insoluble matter in the pitch can efficiently be removed because this solvent exhibits an adequate dissolving power to the pitch. That is, the aromatic solvent having a boiling point of more than 250° C. is generally high in the dissolving power, so that if the pitch is dissolved in the latter solvent such as anthracene oil, only the quinoline insoluble matter such as free carbon, inorganic matter and the like naturally contained in the pitch is substantially separated and removed and consequently the obtained pitch still contains high molecular weight components corresponding to the pyridine insoluble matter. When such a pitch is subjected to a heat treatment, the high molecular weight components having a rich heat reactivity are polycondensed to form mesophase as a secondary quinoline insoluble matter, so that it is difficult to produce a precursor pitch of homogeneous phase suitable for the production of carbon fibers. For this reason, the use of the aromatic solvent having a boiling point of more than 250° C. such as anthracene oil, quinoline and derivatives thereof is not favorable to the invention.

According to the invention, the heat treatment of the purified pitch is carried out at a temperature of 350°–450° C. under a reduced pressure of not more than 20 mmHg, preferably not more than 10 mmHg while passing an inert gas such as an argon gas or the like, whereby benzene insoluble matter and quinoline insoluble matter of the resulting pitch or precursor pitch are reduced to 45–65% by weight and trace amount, respectively.

When the amount of benzene insoluble matter in the pitch after the heat treatment is less than 45%, low molecular weight components in the pitch become large, so that the infusibility after the spinning is poor and the fusing is apt to be caused. While, when it exceeds 65%, the softening point of the pitch becomes higher, and the change in properties of the pitch and the like are apt to be caused during the spinning.

In a first embodiment for practicing the method of the invention, the coal tar pitch containing free carbon is dissolved in the aromatic, low-boiling solvent at a ratio of solvent to coal tar pitch of about 0.5–5 and then subjected to a centrifugal separation, a stationary separation or a filtration to effectively remove free carbon from the pitch and simultaneously remove the pyridine insoluble matter. Then, the purified pitch after the removal of the solvent is heat-treated to easily produce the precursor pitch for the production of carbon fibers having improved heat stability, spinnability and infusibility and a high carbonization yield without performing a specific treatment such as hydrogenation or the like.

When the ratio of solvent to coal tar pitch is less than 0.5, the coal tar pitch can not sufficiently be dissolved in the solvent, while when it excceds 5, the improvement of extraction effect can not be expected and the efficiency of removing the solvent from the pitch after the extraction is deteriorated.

In general, the coal tar pitch contains insoluble solid contents such as free carbon of finely divided particles with a diameter of not more than 1 μm, inorganic ash and the like. In order to use such a pitch as a starting material for the production of carbon fibers, the removal of the solid content is carried out by the centrifugal separation, filtration or the like up to now, which is to separate and remove only the quinoline insoluble matter from the pitch, because the quinoline insoluble mattter in the pitch makes the melt spinning difficult and brings about the decrease of the strength causing a defect of the carbon fiber. On the contrary, according to the invention, the solvent insoluble matter in the pitch is removed by the aromatic, low-boiling solvent (e.g. pyridine), whereby there can effectively be achieved the removal of not only the quinoline insoluble matter but also the thermally unstable high molecular weight components corresponding to the pyridine insoluble matter and consequently the resulting purified pitch is excellent in the heat stability. As a result, by subjecting such a purified pitch to a heat treatment the precursor pitch suitable for the production of carbon fibers can efficiently be produced.

As mentioned above, according to the invention, the precursor pitch for the production of carbon fibers having improved heat stability, spinnability and infusibility can effectively be produced by removing the pyridine insoluble matter inclusive of high molecular weight components from the starting coal tar pitch through the particular aromatic solvent to form a purified pitch and then subjecting the purified pitch to a heat treatment.

The following examples are given in illustration of the invention and are not intended as limitations thereof.

EXAMPLE 1

To a coal tar pitch (softening point: 80° C., quinoline insoluble matter: 3%, pyridine insoluble matter: 6%) was added pyridine as a solvent at a ratio of solvent to pitch of 5, which was subjected to a centrifugal separation to remove the solvent insoluble matter. Then, the solvent was distilled off to obtain a purified pitch having a softening point of 75° C. and containing a trace amount of quinoline insoluble matter and 2% of pyridine insoluble matter.

This purified pitch was subjected to a heat treatment at 430° C. under a reduced pressure of 10 mmHg while bubbling an argon gas to thereby obtain a precursor pitch containing a trace amount of quinoline insoluble matter and 55% of benzene insoluble matter. The thus obtained precursor pitch was isotropic as a whole and had no mesophase spherule as observed by means of a polarizing microscope at a magnification of 200 times after the polishing.

This precursor pitch was melt spun by means of a monohole spinning apparatus having a nozzle diameter of 0.3 mm and L/D=3, which was subjected to an infusing treatment in air at 300° C. for 180 minutes and further to a carbonization treatment at 1000° C. in a nitrogen gas atmosphere to obtain a carbon fiber having a diameter of 10.5 μm, a tensile strength of 105 kg/mm$^2$ and a modulus of elasticity of 4.5 ton/mm$^2$.

EXAMPLE 2

A coal tar pitch was dissolved in a tar light oil (aromatic light oil consisting mainly of benzene, toluene and xylene, boiling point: about 80°–150° C.) at a ratio of solvent to ptich of 2 and then left to stand to remove the solvent insoluble matter. Thereafter, the solvent was distilled off to obtain a purified pitch having a softening point of 85° C. and containing a trace amount of quinoline insoluble matter and 3% of pyridine insoluble matter.

This purified pitch was subjected to a heat treatment at 420° C. under a reduced pressure of 10 mmHg while passing a nitrogen gas to thereby obtain an optically isotropic precursor pitch containing 53% of benzene insoluble matter and 0.2% of quinoline insoluble matter.

The thus obtained precursor pitch was subjected to the same spinning, infusing and carbonization treatments as in Example 1, whereby there was obtained a carbon fiber having a diameter of 9.9 μm, a tensile strength of 86 kg/mm$^2$ and a modulus in tension of 3.8 ton/mm$^2$.

COMPARATIVE EXAMPLE 1

The same coal tar pitch as used in Example 1 was subjected to an extraction with quinoline as a solvent, centrifugal separation and desolvent, whereby there was obtained a pitch having a softening point of 78° C. and containing a trace amount of quinoline insoluble matter and 6% of pyridine insoluble matter. Then, this pitch was heat-treated at 430° C. in the same manner as described in Example 1 to obtain a precursor pitch containing 57% of benzene insoluble matter and 3% of quinoline insoluble matter.

The thus obtained precursor pitch was confirmed to contain mesophase spherules of few μm as observed by means of a polarizing microscope in the same manner as described in Example 1. Further, when the precursor pitch was spun in the same manner as described in Example 1, the fiber breakage was frequently caused, and the resulting carbonized fiber had a diameter of 13 μm and a tensile strength of 52 kg/mm$^2$.

COMPARATIVE EXAMPLE 2

A coal tar pitch was dissolved in an anthracene oil (boiling point: about 270°–360° C.) at a ratio of solvent to pitch of 2 and subjected to a centrifugal separation to remove the solvent insoluble matter and then the solvent was distilled off to obtain a purified pitch having a softening point of 88° C. and containing a trace amount of quinoline insoluble matter and 7% of pyridine insoluble matter.

The purified pitch was subjected to a heat treatment at 440° C. under a reduced pressure of 10 mmHg while passing a nitrogen gas to thereby obtain a precursor pitch containing 55% of benzene insoluble matter and 0.8% of quinoline insoluble matter. In the precursor pitch, the presence of mesophase spherules of few μm was observed by means of a polarizing microscope at a magnification of 200 times. Further, when this precursor pitch was spun in the same manner as described in Example 1, the fiber breakage was frequently caused, and the nozzle was clogged after the spinning for several minutes.

What is claimed is:

1. A method of producing a precursor pitch suitable for the production of carbon fibers, which comprises dissolving a coal tar pitch in an aromatic low-boiling solvent, removing said solvent insoluble matter therefrom, distilling off the solvent to obtain a purified pitch having a softening point of 60°–110° C. and containing no free carbon, and subjecting the purified pitch to a heat treatment for thermal reforming of the pitch so as to obtain optically isotropic precursor pitch containing 45–65% by weight of benzene insoluble matter and not more than 0.3% of quinoline insoluble matter, but no mesophase.

2. The method according to claim 1, wherein said solvent has a boiling point of not more than 250° C. and is selected from compounds having one or two aromatic rings, compounds having one or two alkyl-substituted aromatic rings and a mixture thereof.

3. The method according to claim 1, wherein said solvent is added to said coal tar pitch at a ratio of solvent to pitch of 0.5–5.

4. The method according to claim 1, wherein the removal of said solvent insoluble matter is carried out by centrifugal separation, stationary separation or filtration.

5. The method according to claim 1, wherein said purified pitch contains not more than 5% by weight of pyridine insoluble matter and a trace amount of quinoline insoluble matter.

6. The method according to claim 1, wherein said heat treatment is carried out, while passing an inert gas, at a temperature of 350°–450° C. under a reduced pressure of not more than 20 mmHg.

* * * * *